United States Patent [19]

Amos

[11] 4,165,954

[45] Aug. 28, 1979

[54] LINEAR PERISTALTIC PUMP HAVING PIVOTAL PUMP ARM

[75] Inventor: Lynn G. Amos, Painted Post, N.Y.

[73] Assignee: Corning Glass Works, Corning, N.Y.

[21] Appl. No.: 960,022

[22] Filed: Nov. 13, 1978

Related U.S. Application Data

[63] Continuation of Ser. No. 603,286, Aug. 11, 1975, abandoned.

[51] Int. Cl.[2] ..... F04B 43/08; F04B 43/12; F04B 45/06

[52] U.S. Cl. ..... 417/477

[58] Field of Search ..... 417/474–477, 417/900; 92/13.2, 13.4; 239/93, 101; 128/DIG. 3, 214 F; 222/214

[56] References Cited

U.S. PATENT DOCUMENTS

| | | | |
|---|---|---|---|
| 2,466,618 | 4/1949 | Stocks | 417/477 |
| 3,128,716 | 4/1964 | Stallman et al. | 417/477 |
| 3,425,357 | 2/1969 | Bilichniansky et al. | 417/475 |
| 3,437,050 | 4/1969 | Hrdina | 417/476 |
| 3,542,491 | 11/1970 | Newman | 417/477 |
| 3,876,340 | 4/1975 | Thomas | 417/477 |
| 3,881,641 | 5/1975 | Pliml et al. | 417/476 |
| 3,963,023 | 6/1976 | Hankinson | 417/477 |

*Primary Examiner*—Carlton R. Croyle
*Assistant Examiner*—Thomas I. Ross
*Attorney, Agent, or Firm*—Walter S. Zebrowski; William J. Simmons, Jr.

[57] ABSTRACT

A linear peristaltic pump is disclosed. The pump includes a pivotal pump arm and a flexible tube secured thereto to inhibit longitudinal tube movement. A means for applying a force to such arm, such as a spring, is provided to cause the pump arm to pivot. A stop device is disposed in the path of travel of the pump arm so that the pump arm pivotal travel may be terminated as the pump arm comes to rest against such stop device. The flexible tube is disposed adjacent a surface of the pump arm and is pivotal therewith so that the flexible tube is pinched off between the pump arm surface and the stop device as the pump comes to rest against it. A rotatable roller assembly is provided having at least one roller mounted on a rotatable roller support, the roller intermittently contacting the flexible tube as the roller support is rotated causing a quantity of liquid to be peristaltically moved within the tube. The pump arm may have a concave surface to accommodate the flexible tube and the convex surface of the roller, if desired. The stop device may be adjustable so as to permit adjustment and change of the pivotal travel of the pump arm. The rotatable roller assembly may be caused to intermittently contact the flexible tube through the use of an electric clutch to which the roller assembly is rotatably responsive. The rotatable roller assembly causes the pump arm and flexible tube to pivot in a direction away from the stop device while the means for applying a force causes the pump arm and flexible tube to pivot in a direction towards the stop device.

20 Claims, 7 Drawing Figures

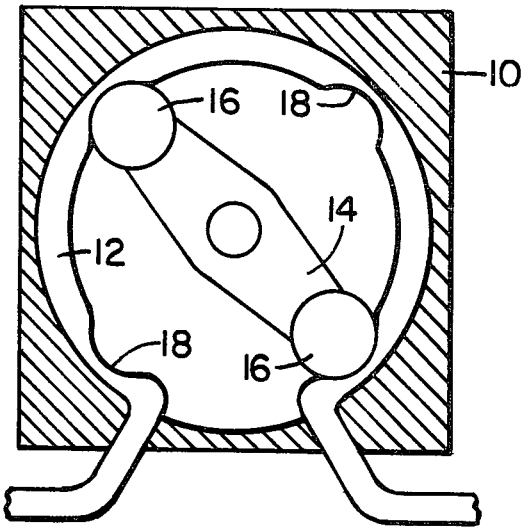
(PRIOR ART)
Fig. 1
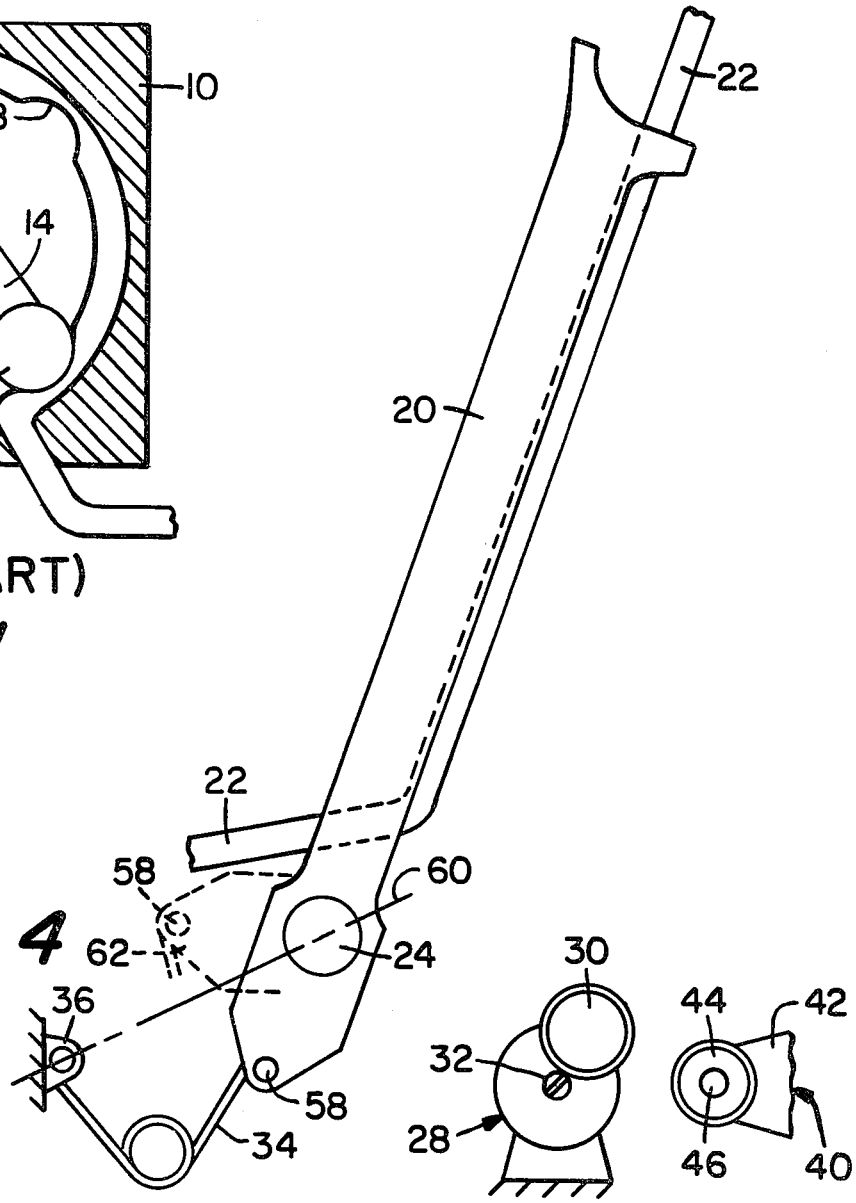
Fig. 4
Fig. 7
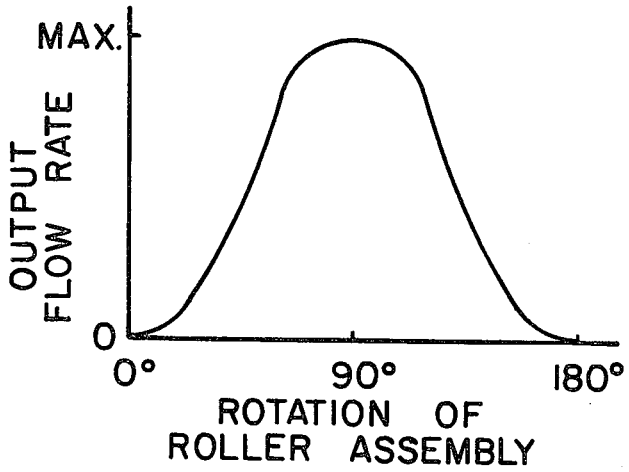

LINEAR PERISTALTIC PUMP HAVING PIVOTAL PUMP ARM

CROSS-REFERENCE TO RELATED APPLICATION

This is a continuation of application Ser. No. 603,286 filed Aug. 11, 1975, now abandoned.

BACKGROUND OF THE INVENTION

1. Field of the Invention

The present invention relates to pumps for liquids but in particular to peristaltic pumps where the liquid does not come into contact with any of the pump parts except the tube within which the liquid flows.

2. Description of the Prior Art

Heretofore, peristaltic-type pumps have been known for use in connection with pumping corrosive or sticky fluids, abrasive slurries, or fluids which cannot be contaminated by pump materials. The greatest advantage of peristaltic-type pumps is that only the substantially inert tube contacts the pumped fluid. The moving pump parts are not damaged by the pumped fluid, such as strong acids or bases, and contamination of the fluid by pump parts is not a problem. Heretofore known peristaltic-type pumps fall into one of two categories, namely the fixed guide or spring loaded guide types. FIG. 1 is an illustration of a typical fixed guide peristaltic pump. The stationary guide 10 has a circular interior configuration. The guide has two openings through which a loop of flexible tube 12 is passed and disposed within the guide. The tube is free to flex but is restrained from longitudinal motion. A rotatable pump impeller 14 is centrally located within the stationary guide. A pair of rollers 16 are mounted at each end of the pump impeller with the impeller-roller assembly having an outside diameter slightly less than the interior diameter of the stationary guide less about two times the typical tube wall thickness, whereby, the tube is pinched closed at the roller locations. As the pump impeller rotates, the pinched-off portion of the flexible tube moves circumferentially along the guide forcing fluid to move along the longitudinal axis of the tubing.

Another type of peristaltic-type pump heretofore known is the spring loaded guide type. This type of pump eliminates the need for precise tube and roller positioning, instead, the guide is pressed against the rollers with sufficient spring force to pinch the tube closed over a plurality of rollers numbering six or more. The pumping action is similar to that of FIG. 1 except that more rollers are used.

Such prior art peristaltic-type pumps have several severe disadvantages. One such disadvantage is that the prior art pumps are completely unsuited to meter flow by intermittent volume delivery, especially if the volume is small. Such prior art pumps are usually calibrated to control flow rates by adjusting the speed of rotation of the pump impeller. Delivery of predetermined volumes would require indexing the pump impeller in equal angular increments with appropriate time delays between movements. Incremental indexing to obtain predetermined volume dispensing, although possible, is complicated and expensive, and calibrating for the exact volume desired would be tedious with prior art pumps.

Another and major disadvantage relates to changes in pump performance after extended idle time in which the pump rollers have not been moved. FIG. 1 illustrates this problem. Since the roller pinches the tube closed with considerable force, the tube may be permanently deformed if the roller is left stationary for a long period of time. That depends on the age of the tube, the tube material, the fluid being pumped, and the deformation force. In prior art pumps it is not unusual for the critical time for substantially permanent deformation to be just a few hours. Permanent deformation of the tube is illustrated at depressions 18 of FIG. 1 whereat the tube is substantially permanently deformed by the pump impeller having previously been idle and stopped such that the rollers of the impeller were disposed at depressions 18. Once the deformation occurs, the pump will deliver a slightly smaller volume for each revolution than it did prior to such deformation. The volume reduction is more pronounced in pumps with closely spaced rollers and thereby more deformations relative to the stroked length of the tube. Furthermore, it is possible for the tube walls to stick together and create a substantially permanent blockage. In such a situation the pump will not prime itself and no flow will result. Still further, tube replacement is difficult and time consuming in prior art peristaltic pumps, thereby rendering pump maintenance costly.

SUMMARY OF THE INVENTION

The objects of this invention are to provide a peristaltic-type pump which is economical, permits metering accuracy after extended periods of inactivity, provides longer pump tube life, provides ease of adjustment for precise volume output, and permits ease of tube replacement. In addition, it is an object of this invention to provide a peristaltic-type pump that yields a nonuniform flow rate which is desirable for certain pump applications.

Broadly, according to the present invention, a linear peristaltic-type pump is provided. This pump includes a pivotal pump arm and a flexible tube secured to the pump arm. A spring or other means is provided for applying a force to the pump arm to cause it to pivot. An intercepting means or stop device is disposed in the path of the pivotal travel of the pump arm to stop such travel of the pump arm by having it come to rest against the intercepting means. The flexible tube is disposed adjacent a surface of the pump arm and pivotal therewith so that the flexible tube is pinched off between a pump arm surface and the intercepting means when the pump arm comes to rest against the intercepting means. A rotatable roller assembly is disposed adjacent the pump arm and the flexible tube for intermittently contacting the flexible tube and peristaltically moving a quantity of liquid therethrough. The rotatable roller assembly comprises at least one roller mounted on a rotatable roller support or arm and is disposed adjacent the pump arm upstream from the intercepting means. Each such roller may have a convex exterior rolling surface. The surface of the pump arm adjacent which the flexible tube is disposed may be concave to accommodate both the flexible tube and the convex surface of the rollers. A clutch device may be connected to the rotatable roller assembly in such manner that the assembly is rotatably responsive to the clutch device. The rotatable roller assembly is intermittently rotated and when stopped, that is in an idle position, the rollers do not contact the flexible tube. The rotatable roller assembly causes the pump arm to pivot in a direction away from the intercepting means and in opposition to the means for applying a force to the pump arm to cause it to pivot. In the idle state, the pump is in a minimum energy state, that is no external indexing device is required for accurate pumping beyond a properly timed release of the clutch device.

Additional objects, features, and advantages of the present invention will become apparent to those skilled in the art, from the following detailed description and the attached drawing on which, by way of example, only the preferred embodiments of this invention are illustrated.

BRIEF DESCRIPTION OF THE DRAWINGS

FIG. 1 is a fragmentary cross-sectional view of a fixed guide type peristaltic pump of the prior art.

FIG. 4 is a fragmentary front elevation view of the linear peristaltic-type pump of the present invention with the pivotal pump arm disposed in a position for flexible tube replacement.

FIG. 7 is a graph illustrating the output flow rate from the linear peristaltic-type pump of the present invention as it varies with the rotation of the roller assembly.

DETAILED DESCRIPTION

Figures 2, 3, 5, 6:
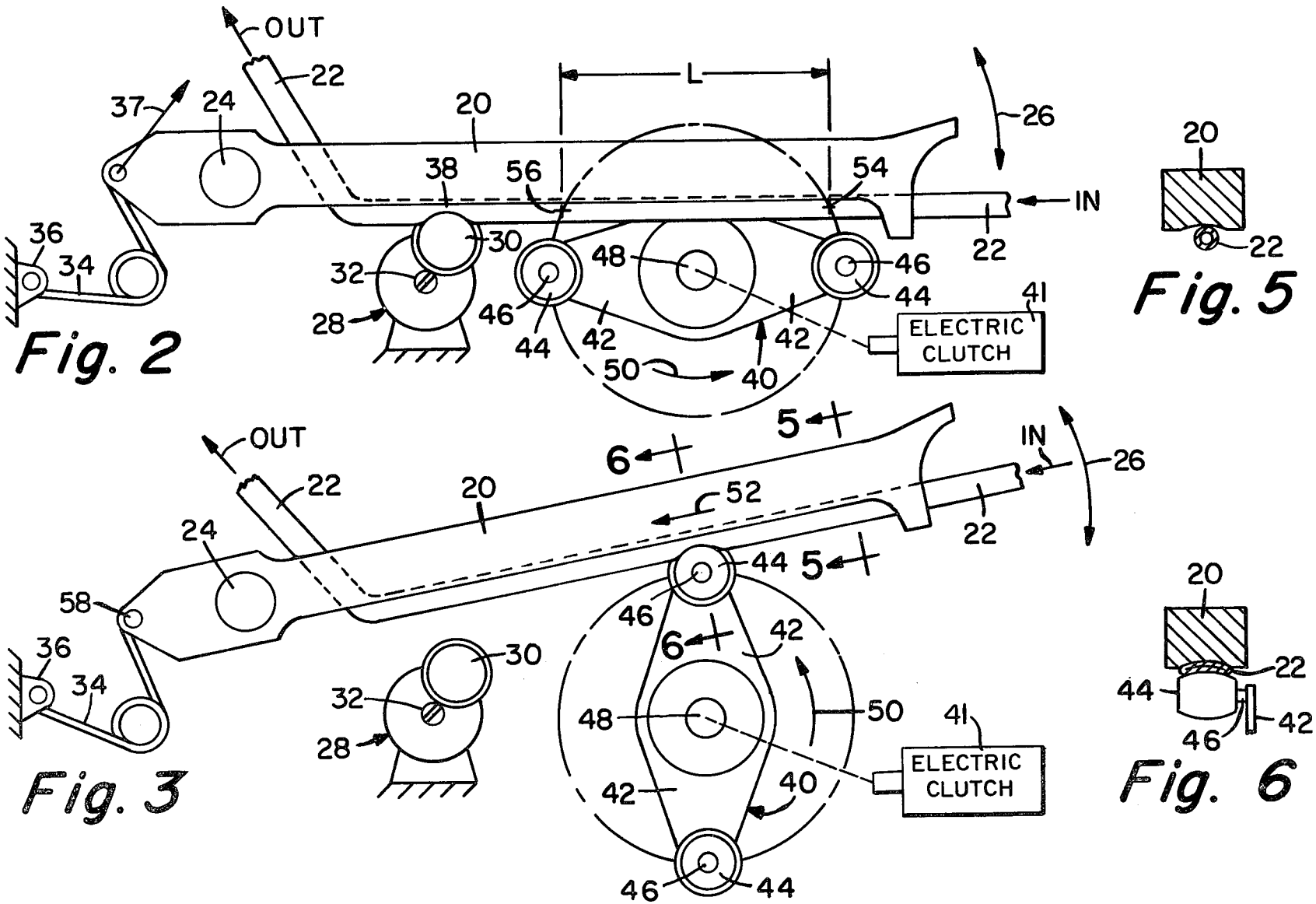
FIG. 2 is a front elevation view, partly diagrammatic, of the linear peristaltic-type pump of the present invention with the rotatable roller assembly in the idle position.
FIG. 3 is a front elevation view, partly diagrammatic, of a linear peristaltic-type pump of the present invention with the rotatable roller assembly in pumping position.
FIG. 5 is a cross-sectional view of the pivotal pump arm and flexible tube taken along lines 5—5 of FIG. 3.
FIG. 6 is a cross-sectional view of the rotatable roller assembly in pumping position against the pump arm and flexible tube taken along lines 6—6 of FIG. 3.

It is to be noted that the figures of the drawing are illustrative and symbolic of the invention, and there is no intention to indicate scale or relative proportions of the elements shown therein. For the purposes of simplicity, the present invention will be described in connection with a pump suitable for the purposes of applying staining reagents to blood film microscope slides, however, the present invention is in no way limited to such utility, rather is applicable to any pumping purpose.

Referring to FIG. 2, there is shown a pivotal pump arm 20 to which a flexible tube 22 is affixed to substantially restrain longitudinal movement thereof. Pump arm 20 is secured for pivotal movement about pivot pin 24 as illustrated by arrow 26. The present linear peristaltic-type pump includes an intercepting means such as a stop device 28 disposed in the path of the pivotal travel of pump arm 20. As shown, stop device 28 is adjustable for changing the position of arm 30 of stop device 28 which in turn changes the length of pivotal travel of pump arm 20. The position of stop arm 30 is changed by simply loosening bolt 32 and rotating stop arm 30 to the desired position.

Pivotal pump arm 20 is caused to pivot in a direction towards stop device 28 by means of a force applied to the pump arm by any suitable means such, for example, as a torsional spring 34 having extended ends, spring 34 being disposed between the end of pivotal pump arm 20 and rigid support 36. The free length of the distance between the spring ends is longer than the distance between pump arm 20 and rigid support 36. When installed as shown in FIG. 2, it provides a force illustrated by arrow 37 on pump arm 20. Although any means for applying a force is satisfactory for the purposes of the present invention, an embodiment including spring 34 is particularly suitable for pump arm control when flexible tube 22 is changed as will hereinafter be described. As spring 34 causes pivotal pump arm 20 to pivot about pivot pin 24, it comes to rest against stop arm 30 which causes tube 22 to be pinched off between stop arm 30 and the surface of pump arm 20 adjacent flexible tube 22. The pinching-off of tube 22 is illustrated by reference numeral 38 whereby any flow through flexible tube 22 is prevented.

Also, adjacent pivotal pump arm 20 and flexible tube 22 is disposed a rotatable roller assembly 40 which includes a pair of roller arms 42. At the end of each roller arm 42 is disposed a roller 44, each of which rollers 44 rotates about its respective pin 46. Roller assembly 40 in turn is rotatable about the longitudinal axis of shaft 48 as illustrated by arrow 50. Shaft 48 is fixedly attached to roller arms 48. FIG. 2 illustrates rotatable roller assembly 40 in its idle position, that is when it is not rotating. Roller assembly 40 may be connected to any intermittent motion device, such for example as an electric clutch 41 whereby roller assembly 40 would be rotated about the longitudinal axis of pin 48 for as long a period of time as may be desired by maintaining the clutch 41 energized. When clutch 41 is de-energized, roller assembly 40 merely completes that portion of its rotation that will bring it to the idle position as illustrated in FIG. 2. The idle position is that position where rollers 44 do not substantially contact flexible tube 22 permitting pivotal pump arm 20 and flexible tube 22 to come to rest against stop arm 30. As will be understood, rotatable roller assembly 40 must complete that portion of its rotation which will bring it to the idle position before it stops otherwise pump arm 20 and flexible tube 22 would not come to rest against stop arm 30, rather would come to rest against one of the rollers 44.

Referring additionally to FIGS. 3, 5, and 6 the operation of the present linear peristaltic-type pump will be described. With the roller assembly 40 in idle position as shown in FIG. 2, and liquid is introduced into flexible tube 22 as shown by arrow labeled IN, the liquid cannot pass out of tube 22 since tube 22 is pinched off at 38 because pump arm 20 and tube 22 is caused to pivot and come to rest against stop arm 30 by spring 34. With electric clutch 41 attached to shaft 48 of rotatable roller assembly 40, the pump is brought into operation by energizing electric clutch 41. As clutch 41 is energized, shaft 48 and in turn roller assembly 40 is caused to rotate in a direction indicated by arrow 50 causing one roller 44 to engage flexible tube 22 pinching off tube 22 at the point of contact with roller 44. As roller assembly 40 continues to rotate, roller 44 continues to collapse flexible tube 22 moving the collapsed portion along in a direction indicated by arrow 52 in FIG. 3. In this manner the liquid in flexible tube 22 is caused to move ahead of roller 44 and out of flexible tube 22. After roller assembly 40 completes about 180° rotation, the clutch is de-energized and pump arm 20 returns to its idle position as illustrated in FIG. 2. So long as clutch 41 is de-energized it will remain in this idle position having moved a predetermined quantity of fluid out of flexible tube 22 with tube 22 then again becoming pinched off at 38 stopping flow therein. On the other hand, if electric clutch 41 is not de-energized after said 180° rotation, roller assembly 40 will continue to rotate for another half revolution or more repeating the cycle hereinabove described.

Referring again to FIG. 2, roller 44 first contacts flexible tube 22 at point 54 and, through about 180° rotation of roller assembly 40, continues in pinched-off contact with flexible tube 22 until it reaches point 56 causing a volume of liquid to be pumped as determined by the internal cross-sectional area of tube 22 and length L. That is, as illustrated in FIG. 2, the amount of liquid contained in tube 22 between points 54 and 56 is pumped through tube 22 for each 180° rotation of roller assembly 40.

FIG. 5 illustrates flexible tube 22 in its normal contact with pivotal pump arm 20. For better positioning and securing of tube 22 to pivotal pump arm 20, the surface of pump arm 20 adjacent tube 22 may be concave as shown in FIG. 5. The outer surface of stop arm 30, as well as rollers 44, may be made convex to correspond to the concave surface of pump arm 20 facilitating each to be operatively accommodated as illustrated by roller 44 in FIG. 6. Such concave-convex surfaces permit good positioning of tube 22, as well as stop arm 30 and rollers 44, whereby flexible tube 22 is positively pinched off permitting greatest pumping efficiency and preventing fluid leakage through the pinched-off area.

Referring again to FIGS. 2 and 3, it is seen that by adjusting stop arm 30 thereby changing the point at which pivotal travel of pump arm 20 is arrested, the length L of the pumping stroke is accordingly changed. The lower stop arm 30 is positioned, the closer flexible tube 22 will be to rollers 44 in their idle position and the pumping stroke L will be longer. On the other hand, when stop arm 30 is positioned higher, flexible tube 22 will be farther away from rollers 44 in their idle position and pumping stroke L will be shorter. As will be understood, for a given tube diameter the volume of liquid pumped is determined by the length of each pumping stroke L and the number of rotations of rotatable roller assembly 40.

Referring now to FIG. 4, there is shown the linear peristaltic-type pump of the present invention wherein pivotal pump arm 20 is pivoted to a stable position such that neither pump arm 20 nor attached flexible tube 22 come to rest against stop arm 30. In this stable condition, the distance between rigid support 36 and pin 58 substantially corresponds to the free length of the extended ends of torsional spring 34. This stable position is achieved by locating rigid support 36, to which one end of spring 34 is affixed, such that the arcual travel of pin 58 crosses line 60. Pin 58 is the point of attachment of the other end of spring 34. Line 60 is the line along which the central axes of rigid support 36 and pivot pin 24 are disposed. As will be understood, in its normal operating position pin 58 would be disposed on one side of line 60 as illustrated by dotted lines 62 in FIG. 4 such that pivotal pump arm 20 and flexible tube 22 would come to rest against stop arm 30. On the other hand, pivotal pump arm 20 and flexible tube 22 would be in a stable non-contacting relationship with stop arm 30 when pin 58 was caused to be pivoted to the other side of line 60. In this stable non-contacting position, flexible tube 22 is readily accessible for replacement or maintenance; pivotal pump arm 20 and the other components of the linear peristaltic-type pump of the present invention being also readily accessible for service and maintenance.

Referring to FIG. 7, there is shown a graph of the typical output flow rate from tube 22 as plotted against degrees of rotation of rotatable roller assembly 40. As is seen, the peristaltic-type pump of the present invention provides non-uniform output flow rates ranging from zero flow rate at the point at which a roller of the rotatable roller assembly contacts flexible tube 22 to a maximum flow rate at the point at which rotatable roller assembly 40 has been rotated through an angle of about 90°. The output flow rate then decreases through the next 90° of rotation until the rotatable roller assembly returns to its idle position at the end of 180° of rotation where the output flow rate is zero again. Such non-uniform flow rates are available for each 180° rotation of the rotatable roller assembly. As will be understood, variations in the curve of the output flow rates may be achieved by varying the length of roller arms 42 as well as the position at which pivotal pump arm 20 and flexible tube 22 come to rest against stop arm 30. Such non-uniform flow rates are particularly desirable in applications where rapid fluid dispersing is desired such, for example, as when applying staining reagents to blood film microscope slides, or the like.

The following is a typical example of the peristaltic-type pump of the present invention. A pump arm 20 as illustrated in the drawings having a nominal pump length of one inch is provided. A flexible tube of natural gum rubber having a ⅛ inch inside diameter and a ¼ inch outside diameter is affixed to the pivotal pump arm by clipping it to the pump arm at one end while passing it through a closely surrounding hole in the other end of the pump arm. The surface of the pump arm adjacent which the flexible tube is affixed is concave to accommodate the flexible tube. By affixing the tube to the pump arm in this manner, significant movement of the tube along its longitudinal axis during pump operation is eliminated. A rotatable roller assembly having rotatable arms slightly longer than ½ inch in length, that is from the center of the pump arm to the center of the roller, is disposed adjacent the pump arm and flexible tube such that the rollers at the ends of the pump arms will contact and compress the flexible tube as the roller assembly is rotated. The roller assembly is attached to an electric clutch controlled by an electrical circuit, the clutch being energizable as desired. A stop arm is disposed downstream of the rotatable roller assembly in a position such that the pump arm and flexible tube come to rest against it when the roller assembly is in an idle position, that is in a substantially non-contacting relationship with the flexible tube and pump arm. The rollers at the ends of the roller arms and the stop arm have a convex curvature substantially corresponding to the concave curvature of the pump arm. A torsional spring is attached to one end of the pump arm to provide a force which causes the pump arm to pivot so as to come to rest against the stop arm and pinch-off the flexible tube preventing flow therethrough. The pumping stroke is approximately one inch and with the roller assembly rotating at 60 rpm, the output from a ⅛ inch inside diameter tube would be about 0.20 cubic centimeters for each 0.5 seconds of clutch engagement. The above described peristaltic-type pump provides metering accuracy despite extended periods of inactivity, provides longer pump tube life, provides easy adjustment for precise volume output, and permits ease of tube replacement. It also provides a non-uniform flow rate for rapid fluid dispensing from the output.

Although the present invention has been described with respect to specific details of certain embodiments thereof, it is not intended that such details be limitations upon the scope of the invention except insofar as set forth in the following claims.

I claim:

1. A pump comprising a pivotal pump arm which pivots about a first axis, a flexible tube, means for applying a force to said pump arm to cause it to pivot, intercepting means disposed in the path of travel of said pump arm for stopping said travel of said pump arm in one direction, said flexible tube being disposed adjacent a surface of said pump arm and pivotal therewith so that said flexible tube is pinched-off between said pump arm surface and said intercepting means as said pump arm comes to rest against said intercepting means, the position of said intercepting means being adjustable so as to at least in part change the pivotal travel of said pump arm and thereby change the pumping stroke, rotatable roller means disposed adjacent said pump arm and said flexible tube and upstream from said intercepting means for intermittently contacting said flexible tube and peristaltically moving a quantity of liquid therein, said rotatable roller means comprising at least one roller mounted on a rotatable roller support, said roller being rotatable on said roller support, the axis about which said roller rotates being parallel to said first axis, and spring means with one end affixed to a rigid support for pivoting said pivotal pump arm in a direction opposite to said one direction to a raised stable position such that said pump arm is in a non-contacting relationship with both said intercepting means and said rotatable roller means when desired.

2. The pump of claim 1 wherein said means for applying a force is a spring.

3. The pump of claim 1 wherein said surface of said pump arm is concave to accommodate said flexible tube.

4. The pump of claim 1 wherein said roller means comprises a pair of rollers mounted on opposite ends of a rotatable roller support, said rollers being rotatable on said roller support.

5. The pump of claim 4 wherein the exterior surface of said rollers is convex.

6. The pump of claim 5 wherein said surface of said pump arm is concave to accommodate said flexible tube and said convex surface of said rollers.

7. The pump of claim 3 wherein said intercepting means comprises a member having a convex exterior surface for cooperative association with said pump arm concave surface.

8. The pump of claim 1 wherein said flexible tube is secured to said pivotal pump arm to substantially restrain longitudinal movement thereof with respect to said pump arm.

9. The pump of claim 1 further comprising an electric clutch connected to said rotatable roller means.

10. The pump of claim 9 wherein said rotatable roller means is rotatably responsive to said clutch device.

11. The pump of claim 10 further comprising means for stopping said rotatable roller means in a non-contacting position with said flexible tube.

12. The pump of claim 1 wherein said rotatable roller means causes said pump arm to pivot in a direction away from said intercepting means.

13. The pump of claim 1 wherein said means for applying a force is a spring and wherein said rotatable roller means comprises a pair of rollers mounted on opposite ends of a rotatable roller support, said rollers being rotatable on said roller support.

14. The pump of claim 13 wherein the exterior surface of said rollers is convex.

15. The pump of claim 14 wherein said surface of said pump arm is concave to accommodate said flexible tube and said convex surface of said rollers.

16. The pump of claim 15 wherein said intercepting means comprises a member having a convex exterior surface for cooperative association with said pump arm concave surface.

17. The pump of claim 16 wherein said flexible tube is secured to said pivotal pump arm to substantially restrain longitudinal movement thereof with respect to said pump arm.

18. The pump of claim 17 further comprising an electric clutch connected to said rotatable roller means.

19. The pump of claim 18 wherein said rotatable roller means is rotatably responsive to said clutch device.

20. The pump of claim 19 further comprising means for stopping said rotatable roller means in a non-contacting position with said flexible tube.

* * * * *